US005655265A

United States Patent [19]

Schneider et al.

[11] Patent Number: 5,655,265

[45] Date of Patent: Aug. 12, 1997

[54] SPLIT STRAP TAKE-UP ASSEMBLY METHOD OF USE

[75] Inventors: William A. Schneider, Conroe; E. C. Crosby, Montgomery; Edward B. Cannan, Jr., Conroe, all of Tex.

[73] Assignee: Fluid Containment, Inc., Conroe, Tex.

[21] Appl. No.: 439,816

[22] Filed: May 12, 1995

[51] Int. Cl.[6] ..... B65D 63/02

[52] U.S. Cl. ..... 24/21; 24/19; 24/68 R; 405/52

[58] Field of Search ..... 24/19, 16 R, 21, 24/24, 68 R, 68 CD, 20 TT, 370, 372, 573.3; 405/52

[56] References Cited

U.S. PATENT DOCUMENTS

| | | | |
|---|---|---|---|
| 1,235,346 | 7/1917 | Lucas | 24/573.3 |
| 2,761,109 | 8/1956 | Hacker | 24/370 |
| 2,777,668 | 1/1957 | Huber | 24/68 CD |
| 4,627,133 | 12/1986 | Bartlow | 24/68 R X |

FOREIGN PATENT DOCUMENTS

| | | | |
|---|---|---|---|
| 798388 | 1/1981 | U.S.S.R. | 24/68 R |
| 1275170 | 12/1986 | U.S.S.R. | 24/68 R |

*Primary Examiner*—James R. Brittain

*Attorney, Agent, or Firm*—Chamberlain, Hrdlicka, White, Williams & Martin

[57] ABSTRACT

An apparatus for tightening strap members comprises a buckle member having a first means for attachment to a strap and a second means for attachment to a strap. A plurality of longitudinally spaced apart pin-receiving boreholes are provided on slidably related sections of the buckle member such that the boreholes in one section have a vernier relationship with the boreholes in another section, thus permitting a boreholes to come into alignment as the sections are slid past each other at an adjustment increment which is less than the spacing between the boreholes on either section. A method is also provided for using the assembly to tightening a strap.

20 Claims, 5 Drawing Sheets

SPLIT STRAP TAKE-UP ASSEMBLY METHOD OF USE

BACKGROUND OF THE INVENTION

This invention relates to the installation of horizontal tanks, in particular underground fiberglass storage tanks. In one aspect, this invention relates to an assembly to engage and tighten the hold-down straps. In another aspect, this invention relates to using the assembly of the invention.

Tanks mounted in the horizontal position must be anchored to prevent movement. In particular, underground fiberglass storage tanks need to be stabilized. Traditional methods of anchoring underground tanks require shoring or other hole stabilization techniques. Further, a man must enter to shored hole during the anchoring process resulting in a hazardous working situation. An apparatus and method to provide a safer, less costly anchoring system would be very desirable.

OBJECTS OF THE INVENTION

It is an object of the invention to provide an assembly which can be used to tighten straps.

It is another object of the invention to provide an assembly which can be used in anchoring horizontal tanks, in particular underground fiberglass storage tanks.

It is a further object of the invention to provide a cost effective assembly which is may be used with minimum instruction.

It is further an object of the invention to provide a method for anchoring an underground tank that minimizes the need for shoring or other hole stabilization techniques.

It is still further an object of the invention to provide a means for anchoring an underground storage tank without placing a man at work beneath ground level.

It is still further an object of the invention to provide a method for anchoring a tank that allows for simple and rapid anchoring.

SUMMARY OF THE INVENTION

In one aspect of the invention a buckle member having a first means for attachment to a strap and a second means for attachment to a strap forms an assembly for taking up (tightening) the strap. The buckle member comprises a base plate and an upright plate connected to the base plate to form an inverse T-shaped cross-section. The upright plate defines a plurality of longitudinally spaced apart pin-receiving boreholes extending therethrough. The means for attachment to a strap comprises an elongated plate member, which has a means for attachment to a strap located near an second end, and a plurality of longitudinally spaced apart pin-receiving boreholes extending therethrough. The boreholes in the elongated plate member have a first spacing relationship and the boreholes in the upright plate have a second spacing relationship so that the boreholes in the elongated plate member have a vernier relationship with the boreholes in the upright plate. This permits a borehole in the elongated plate member to come into alignment with a borehole in the upright plate, as the elongated plate member is slid past the upright member, at an adjustment increment which is less than the spacing between either the boreholes through the upright member or the boreholes through the elongated member. The aligned holes are then held by a pin sized to be closely received by the boreholes.

In another aspect of the invention, a method is provided for using the assembly to tightening a strap. Straps are affixed to the assembly at the means for attachment to a strap. The first plate member is slid past the second plate member of the assembly until the strap is tightened and a borehole in the first plate member is aligned with a borehole in the second plate member. A pin is then positioned in the aligned holes of the first plate member and the second plate member to hold the strap in the tightened position.

BRIEF DESCRIPTION OF THE DRAWINGS

FIG. 2 shows the slider section and an option of the assembly seen in FIG. 1, wherein

FIG. 3 shows the slot sections of the assembly seen in FIG. 1, wherein

FIG. 4 shows the slider foot sections of the assembly seen in FIG. 1, wherein

FIG. 6 shows the slider section of the assembly seen in FIG. 5, wherein

FIG. 7 shows the slot section and the strap hook section of the assembly seen in FIG. 5, wherein

FIG. 8 shows a detail of the strap hook section of the assembly seen in FIG. 5, wherein

DETAILED DESCRIPTION OF THE PREFERRED EMBODIMENTS

Figure 1:
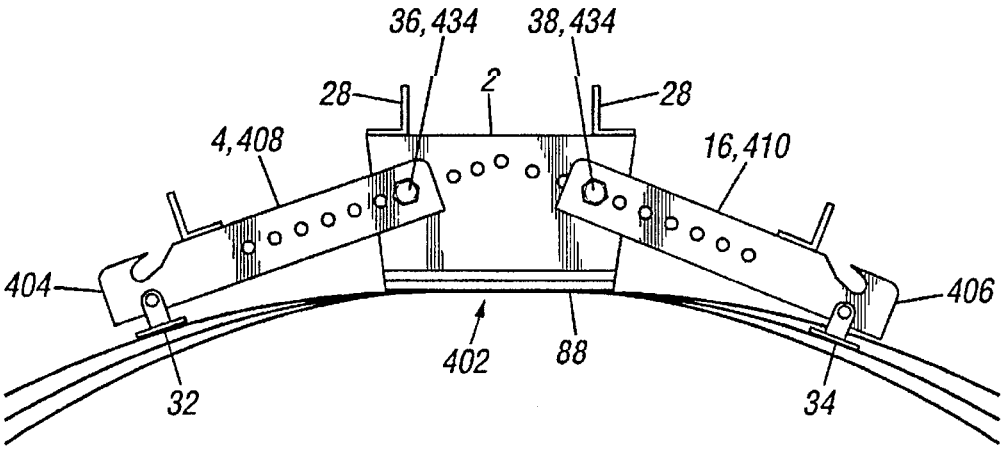
FIG. 1 shows one embodiment of the invention as it would appear when placed on a rib of a horizontally oriented tank.

Referring to the drawings, an assembly for taking up a strap is provided. The assembly comprises a buckle member 402 which has a first end 404 and a second end 406, the first end having a first means 408 for attachment to a strap and the second end 406 having a second means 410 for attachment to a strap. The buckle member 402 further comprises a base plate 412, and an upright plate 414. The upright plate has a first side surface 416 and a second side surface 418 and the upright plate is connected substantially perpendicularly to the base plate 412, forming an elongated buckle member which has an inverse T-shaped cross-section. The upright plate 414 also defines a plurality of pin-receiving boreholes 420 extending therethrough longitudinally spaced apart from the first side surface 416 to the second side surface 418 from a position adjacent to the first end 404 of the buckle member 402. The first means for attachment to a strap is an elongated plate member 408 having a first end 422, a second end 424, a first side surface 426, and a second side surface 428. The elongated plate member 408 has a means for attachment 430 to a strap located near the second end 424. A plurality of longitudinally spaced apart pin-receiving boreholes 432 extend therethrough the elongated plate member 408 from a position adjacent to the first end 422 of the elongated plate member 408.

The spacing of the boreholes is chosen to enable the buckle member to function with vernier characteristics. The boreholes 432 in the elongated plate member 408 have a first spacing relationship and the boreholes 420 in the upright plate 414 have a second spacing relationship. This causes the boreholes 432 in the elongated plate member 408 to have a vernier relationship with the boreholes 420 in the upright plate 414, and permits a borehole 420 in the upright plate 414 to come into alignment with a borehole 432 in the elongated plate member 408 as the first side surface 426 of the elongated plate member 408 is slid past the first side surface 416 of the upright member 414. The resulting adjustment increment is less than the spacing between either the boreholes through the upright member 414 or the boreholes through the elongated member 408. The boreholes are held in alignment with a pin 434 sized to be closely received by the boreholes 420 432. The pin 434 has a first end and a second end. A head is positioned at the first end and a tapering surface is positioned adjacent to the second end.

Referring to FIGS. 1, 2, 3, and 4, in an embodiment of the invention a split strap take-up assembly is shown comprising an elongated slider section 2, a first slot section 4 and a second slot section 16, both in slidable relation to the slider section 2. The two, substantially mirror image slot sections each have a J-shaped groove 6 18 in a top edge 8 20 which is designed to hold the eye end of a fiberglass strap. The J-shaped grooves 6 18 extend from a first side surface 10 22 to a second side surface 12 24 and open towards a first side edge 14 26. At least one tightener connection 28 is attached to a top edge 30 of the slider section 2. In a preferred embodiment, the slider section is equipped with two tightener connections, one at each end. At least one tightener connection 28 is attached to the top edge 8 of the first slot section 4, forward of the J-groove 6 and at least one tightener connection 28 is attached to the top edge 20 of the second slot section 16, forward of the J-groove 18. Each slot section is also equipped with a slider foot near an end. The first slider foot 32 is pivotally connected to the first slot section 4 and the second slider foot 34 is pivotally connected to the second slot section 16. The slot sections are connected to the slider section by a first and second holding means 36 which is removably affixed.

Figure 2A:
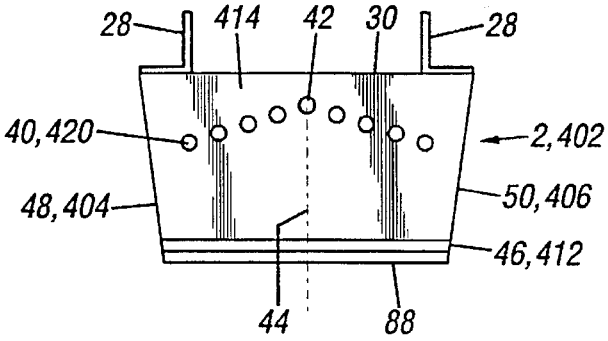
FIG. 2*a* is a front view.
Figure 2C:
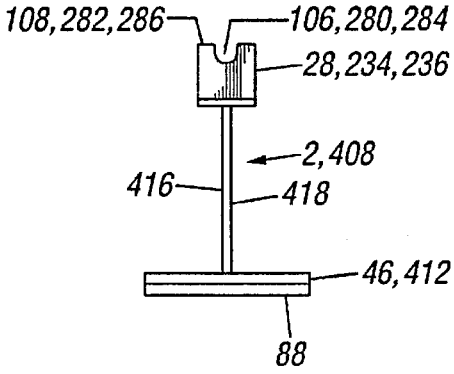
FIG. 2*c* is a side view.
Figure 2B:
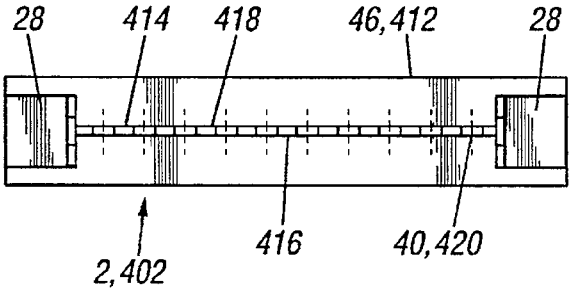
FIG. 2*b* is a top view.

In a preferred embodiment of the invention, the elongated slider section 2 has an inverse T-shaped cross-section when viewed through a transverse plane and a plurality of holes 40 in a substantially V-shaped pattern, as shown in FIG. 2. The V-shape has an apex 42 near the top edge 30 of and at a transverse axis 44 of the slider section 2. The first leg of the V extends towards a bottom plate 46 and a first side edge 48 at an angle between 60° and 80° from the transverse axis 44. The second leg of the V extends towards the bottom plate 46 and a second side edge 50 at an angle between 60° and 80° from the transverse axis 44. The plurality of holes 40 in the elongated slider section 2 each have a center. It has been found that the assembly functions well when the centers are spaced between 2.85 cm and 3.49 cm apart and the diameter of each hole is sized to receive a holding means 36 about 1.75 cm in diameter.

Figure 3A:
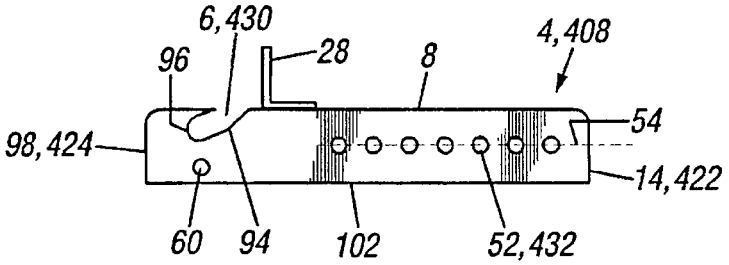
FIGS. 3*a* and 3*b* are front views of substantially mirror image sections and FIG. 3*c* is a top view.
Figure 3B:
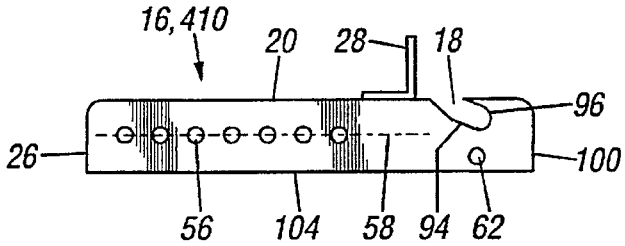
Figure 3C:
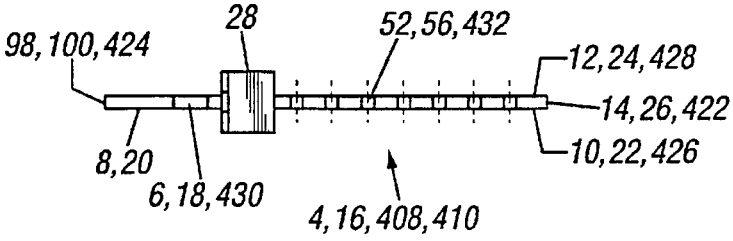

The two slot sections 4 16 are substantially rectangular shaped and made from 0.318 cm to 1.9 cm thick plate. As shown in FIG. 3, each slot section has a plurality of holes 52 56 equally spaced along a longitudinal axis 54 58. The holes extend from the first side surface 10 22 to the second side surface 12 24. The holes 52 56 are substantially similar in size to the holes 40 in the elongated slider section 2. Each slot section 4 16 has a pivot hole 60 62 extending from the first side surface 10 22 to the second side surface 12 24. The pivot hole 60 62 is positioned beneath the J-shaped groove 6 18 and near a second end of each slot section. The plurality of holes 52 56 in the first 4 and second 16 slot sections each have a center. For optimum function, the holes in the slot sections should not be spaced the same as the holes in the slider section. It has been found that the assembly functions well when the centers are spaced between 3.49 cm and 4.13 cm apart. The diameter of the holes should be substantially similar to the diameter of the holes in the slider section to facilitate use of the holding means. A diameter which can receive a holding means 38 about 1.75 cm in diameter has been found to work well.

The J-shaped grooves 6 18 in the first 4 and second 16 slot sections are each capable of receiving the eye end of a fiberglass strap with an opening along the top edge 8 20 of between 2.85 cm and 3.49 cm. The J-shaped grooves 6 18 have a first long side 94 and a second short side 96 which is substantially parallel to the first long side 94. The eye end of a fiberglass strap is securely held when the second short leg 96 is spaced between 1.9 cm and 2.54 cm from the first long side 94 and should be uppermost towards the top edges 8 20 of the first 4 and second 16 slot sections. Both sides 94 96 of the J-shaped grooves 6 18 are between 75° and 77° from a second side edge 98 100 of the first 4 and second 16 slot sections. The apex of each J-shape is between 4.45 cm and 5.72 cm from the second edges 98 100 and between 3.49 cm and 4.76 cm from a bottom edge 102 104 of the first 4 and second 16 slot sections.

Figure 4A:
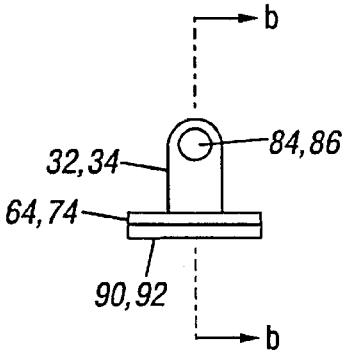
FIG. 4*a* is a front view and FIG. 4*b* is a side view.
Figure 4B:
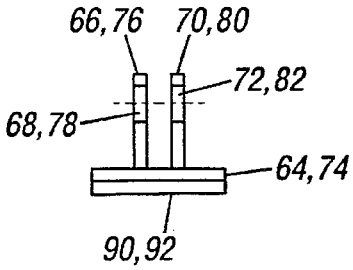

A slider foot is associated with each slot section. As seen in FIG. 4, the slider feet 32 34 each comprise a bottom plate 64 74, a first side plate 66 76 and a second side plate 70 80. The first side plate 66 76 is substantially perpendicular to and attached by a bottom edge to a top surface of the bottom plate 64 74. The first side plate has a hole 68 78 which extends from a first surface to a second surface and is substantially parallel to the bottom plate 64 74. The hole 68 is similar in size to the pivot hole 60 in the first slot section 4 and the pivot hole 62 in the second slot section 16. The second side plate 70 80 is attached by a bottom edge to the top surface of the bottom plate 64 74 and is substantially parallel to and spaced apart from the first side plate 66 76. The second side plate 70 80 has a hole 72 82 which extends from a first surface to a second surface and is substantially parallel to the bottom plate 64 74. The hole 72 82 is the second plate 70 80 is similar in size to and concentric with the hole 68 78 of the first side plate 66 76. The first slot section 4 is pivotally received between the first 66 and second 70 side plates of the first slider foot 32 and the second slot section 16 is pivotally received between the first 76 and second 80 side plates of the second slider foot 34. A first pivot means 84 is provided to pass through the pivot hole 60 of the first slot section 2 and the holes 68 72 of the first slider foot 32 and a second pivot means 86 is provided to pass through the pivot hole 62 of the second slot section 16 and the holes 78 82 of the second slider foot 34.

The optional tightener connections can accept a multiple-use tightener to assist and speed up the take-up operation. Each tightener connection 28 has an U-shaped groove 106 at a top edge. The U-shaped groove is between 1.58 cm and 2.22 cm wide with an apex of the groove 106 between 1.58 cm and 2.22 cm from a top edge 108. Almost any shape tightener connection may be used. L-shaped connections have been used successfully.

It is preferable to provide a first rubber pad 88 mounted to a bottom surface of the bottom plate 46 of the slider section 2. The rubber pad reduces damage to the fiberglass tank and helps the assembly conform tightly to the curvature of the fiberglass tank. A second rubber pad 90 may also be mounted to a bottom surface of the bottom plate 64 of the first slider foot 32 and a third rubber pad 92 may be mounted to a bottom surface of the bottom plate 74 of the second slider foot 34. Corrosion protection is applied to the assembly, such as coal tar paint or galvanizing, to protect from corrosion when the assembly is used to anchor underground tanks.

FIGS. 5, 6, 7 and 8 show another embodiment of the invention comprising a slider section 202 having a J-shaped groove 204 in a top edge 206, a slot section 214, a strap hook section 220 attached to the slot section 214 and having a J-shaped groove 222 in a top edge 224 and a bottom plate 232. The J-shaped groove 204 in the slider section 202 extends from a first side surface 208 to a second side surface 210 and opens towards a first side edge 212. The slot section 214 is slidably related to the slider section 202. The slider section comprises a first leg 216 and a second leg 218 which is parallel to and spaced apart from the first leg 216. The J-shaped groove 222 in the slot section extends from a first side surface 226 to a second side surface 228 and opens towards a first side edge 230. The first leg 216, second leg 218, and strap hook section 220 are all attached by their respective bottom edges to a top surface of the bottom plate. A first tightener connection is mounted to the top edge 206 of the slider section 202 near the first side edge 212. A slider foot 238 is mounted to a bottom edge 276 of the slider section 202 near a second edge 272. A second tightener connection 236 is attached to the slot section 214. A holding means 240 is removably affixed to the slider section 202 and the slot section 214.

Figure 6A:
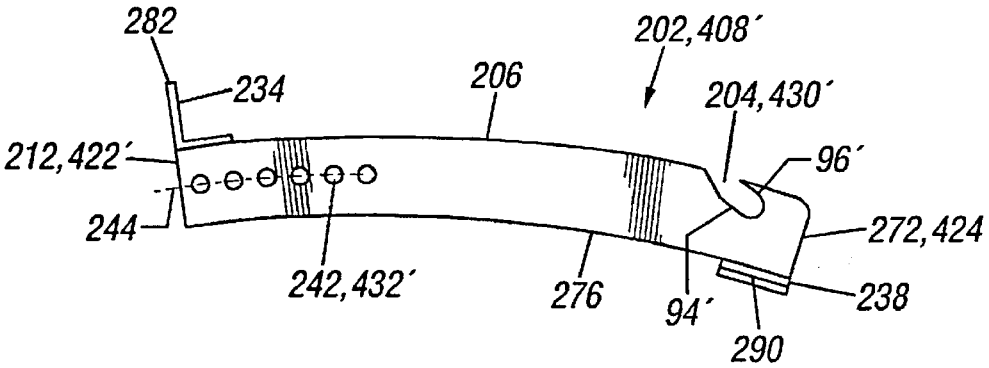
FIG. 6*a* is a front view and FIG. 6*b* is a top view.
Figure 6B:
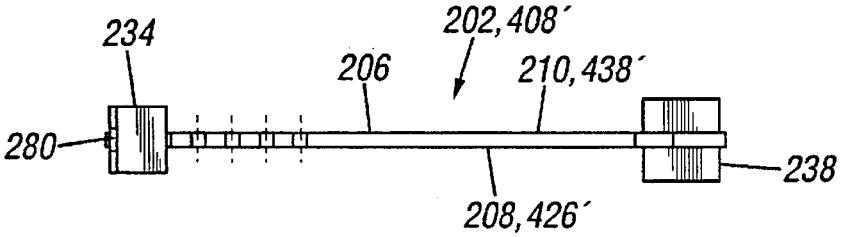

In a preferred embodiment of the invention, the slider section 202 is a substantially arc-shaped 0.32 cm to 0.95 cm thick by 6.35 cm to 7.62 wide plate defined at the top edge 206 by an angle of about 28.6° at a radius of about 64.77 cm, as shown in FIG. 6. The slider section 202 has a plurality of holes 242 extending from the first side surface 208 to the second side surface 210 along a central arc 244. Each hole 242 has a center. It has been found that the assembly functions well when the centers of the holes 242 are spaced between 2.85 cm and 3.49 cm apart and the diameter of each hole 242 is sized to receive a holding means 240 about 1.75 cm in diameter.

Figure 7A:
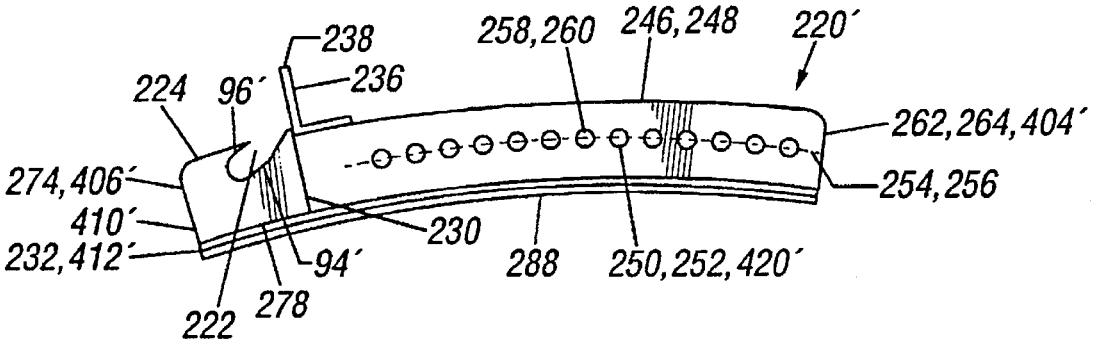
FIG. 7*a* is a front view and FIG. 7*b* is a top view.
Figure 7B:
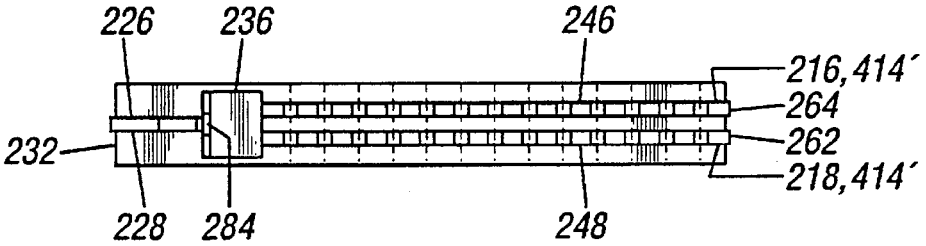
Figure 8A:
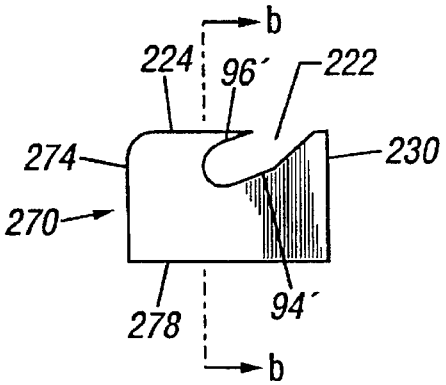
FIG. 8*a* is a front view and FIG. 8*b* is a side view.
Figure 8B:
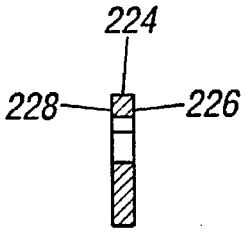

The first 216 and second 218 legs of the slot section 214 are also substantially arc-shaped 0.31 cm to 0.64 cm thick plates defined at a top edge 246 248 by an angle of about 26.0° at a radius of about 58.42 cm, as shown in FIG. 7. The slider section 202 containing a tightener connection 234 should be free to slide between the legs of the slot section. Good slidability is obtained when the first 216 and second 218 legs have a height about 0.63 cm less than the width (height) of the slider section 202. The first 216 and second 218 legs each have a plurality of holes 250 252 which follow a central arc 254 256 and each hole 250 252 has a center. The centermost holes 258 260 are located about 12.2° at a radius of about 31.0 cm away from a side edge 262 264 of each the first 216 and second 218 leg. As previously explained, the holes in the slot sections should not be spaced the same as the holes in the slider section. It has been found that the assembly functions well when the centers are spaced between 3.49 cm and 4.13 cm apart. The diameter of the holes should be substantially similar to the diameter of the holes in the slider section to facilitate use of the holding means. A diameter which can receive a holding means 240 about 1.75 cm in diameter has been found to work well.

The strap hook section 220 is a substantially arc-shaped 0.32 cm to 0.95 cm thick plate. The bottom plate 232 is a substantially arc-shaped 0.15 cm to 0.48 cm thick plate defined by an angle of about 31.1° at a radius of about 66.36 cm. The slider foot 238 is formed from 0.15 cm to 0.48 cm thick plate material. The J-shaped grooves 204 222 in the slider section 202 and the strap hook section 220 and the tightener connections are substantially shaped and sized as described earlier. The first tightener connection 234 is attached to the slider section 202 and has the U-shaped groove 280 in a top edge 282. The second tightener connection 236 is attached to the top edge 246 of the first leg 216 and the top edge 248 of the second leg 218 of the slot section 214.

It is preferable to mount a first rubber pad 288 to a bottom surface of the bottom plate 232 and a second rubber pad 290 to a bottom surface of the slider foot 238. The pads reduce damage to the fiberglass tank and help the assembly conform tightly to the curvature of the fiberglass tank.

The aforedescribed split strap take-up assemblies may be used to anchor an underground fiberglass storage tank without having to send a man into a hole beneath ground level, thus substantially increasing the safety of installation. Generally, a first strap end and a second strap end are provided with a connecting means between the first strap end and the second strap end. A first elongated plate member is then affixed to the first strap end and a second elongated plate member is affixed to the second strap end. Each of the first elongated plate member and the second elongated plate member have a first surface and a second surface and a plurality of longitudinally spaced apart boreholes extending therethrough from the first side surface to the second side surface. The boreholes in the first elongated plate member have a first spacing relationship and the boreholes in the second elongated plate member have a second spacing relationship so that the boreholes in the first elongated plate member have a vernier relationship with the boreholes in the second elongated plate member. This permits a borehole in the first elongated plate member come into alignment with a borehole in the second elongated plate member as the first side surface of the first elongated plate member is slid past the first side surface of the second elongated plate member at an adjustment increment which is less than the spacing between either the boreholes through the first elongated plate member or the boreholes through the second elongated member. The first side of the first plate member is slid past the first side of the second plate member until the strap is tightened and a borehole in the first elongated plate member is aligned with a borehole in the second elongated plate member. A pin is then positioned in the aligned holes of the first elongated plate member and the second elongated plate member to hold the strap in the tightened position.

Figure 9:
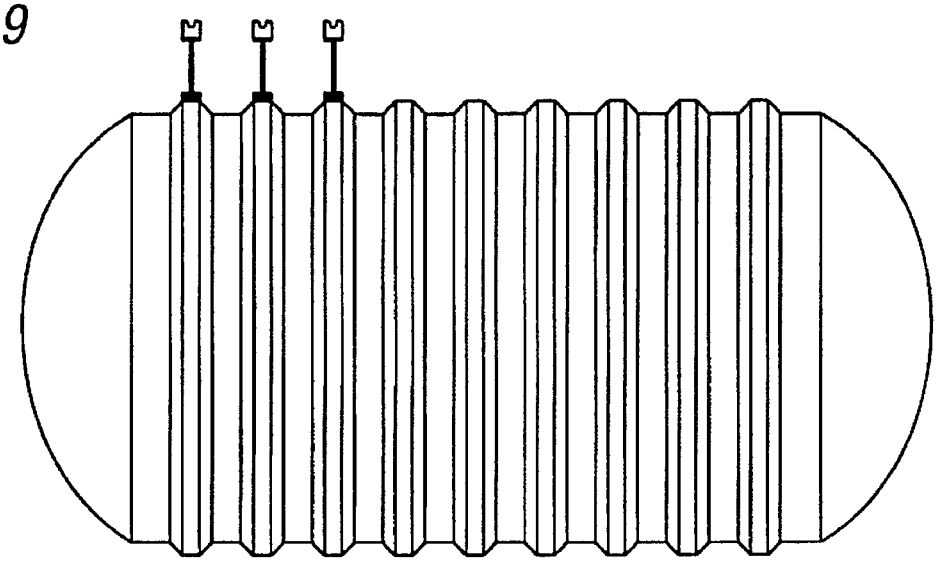
FIG. 9 is a pictorial illustration of the assembly of FIG. 1 ready for installation on a ribbed fiberglass tank.

To use the assembly shown in FIGS. 1, 2, 3, and 4 one should install an underground fiberglass storage tank having a plurality of anchor ribs, a first plurality of deadmen or anchor pads on one side of the tank wherein each first deadman or anchor pad is in alignment with an anchor rib, and a second plurality of deadmen or anchor pads on a circumferentially opposite side of the tank. Ideally there should be a deadman or anchor pad adjacent to and in alignment with each rib of the tank when the tank is in the horizontal position shown in FIG. 9. The hook end of a first fiberglass strap having a hook end and an eye end is then attached to a first deadman or anchor pad. The hook end of a second fiberglass strap having a hook end and an eye end is attached to a second deadman or anchor pad in opposite association with the same rib as the first deadman or anchor pad. Ideally the straps should have a working load of at least 5200 lbs. Next, a split strap take-up assembly, as previously described and shown in FIGS. 1, 2, 3, and 4, is placed on the rib in association with the first and second fiberglass straps, as shown in FIG. 9. The rubber pads of the assembly should be installed to enhance fit and protect the tank. The eye end of the first fiberglass strap is placed in the J-shaped groove of the first strap hook section and the eye of the second fiberglass strap is placed in the J-shaped groove of the second strap hook section. A multiple use tightener, may be used to facilitate tightening of the fiberglass straps. If tighteners are used, one is attached to one tightener connection on the slider section and a tightener connection on the first slot section and second tightener is attached to a second tightener connection on the slider section and to a tightener connection on the second slot section. Keeping tension on the first and second fiberglass straps the first holding means is removed and the first tightener is ratcheted until a second hole on the slider section is aligned with a second hole on the first slot section. The slider section and first slot section are then pinned together by passing the first holding means through the aligned holes. The second holding means is now removed and the second tightener is ratcheted until a third hole on the slider section is aligned with a second hole on the second slot section. The slider section and the second slot section are pinned in place by passing the second holding means through the aligned holes. The ratcheting and pinning steps are repeated until the first and second fiberglass straps are snug but not overtight. Allowable rib loading in radial compression may be about 200 lbs/in for an 8 foot to 10 foot diameter fiberglass tank. The entire process is repeated for each of the ribs on the tank.

Figure 5:
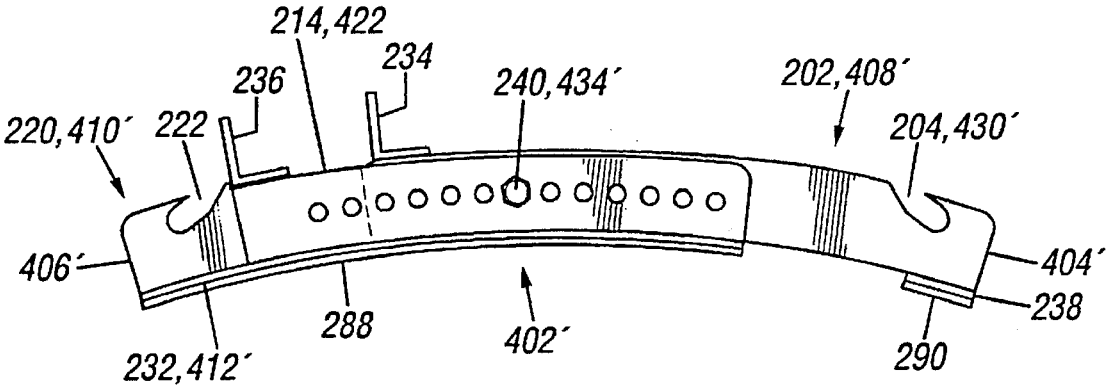
FIG. 5 shows another embodiment of the invention as it would appear in the assembled condition.
Figure 10:
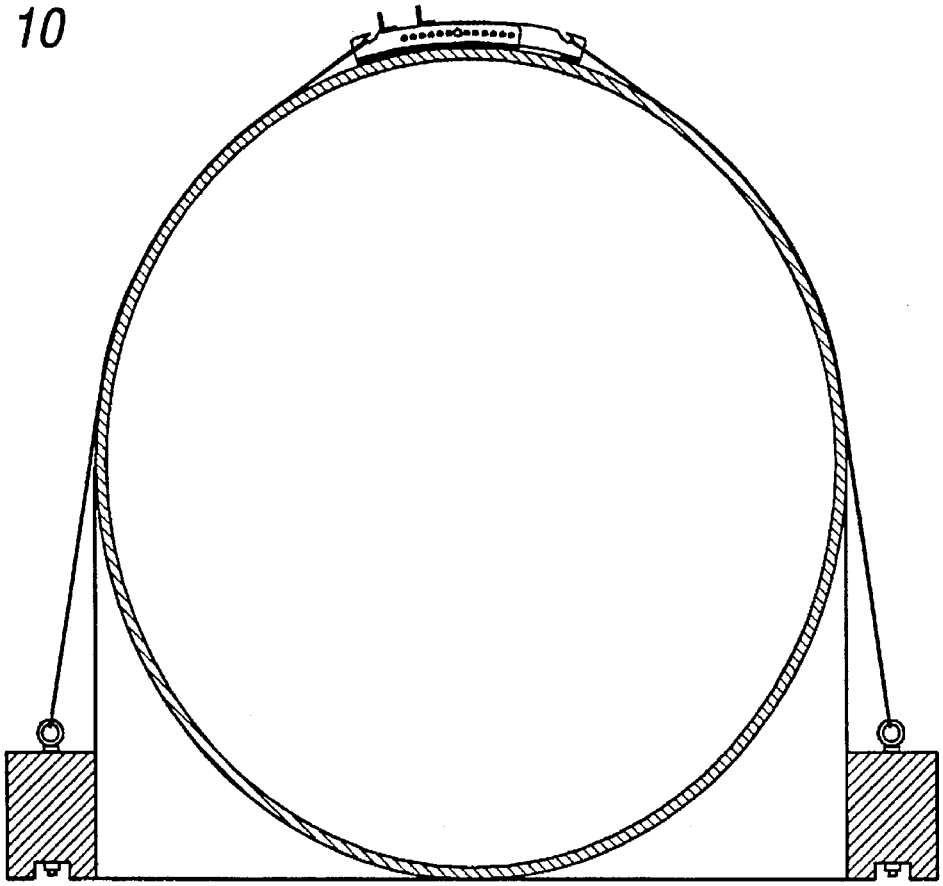
FIG. 10 is a pictorial illustration of the assembly of FIG. 5 as it would appear after installation.

The initial steps of use are similar when the assembly shown in FIGS. 5, 6, and 7 is used. However, the tightening and ratcheting steps are slightly different. The eye end of the first fiberglass strap is placed in the J-shaped groove of the slider section and the eye of the second fiberglass strap is placed in the J-shaped groove of the strap hook section. A properly placed take-up assembly looks substantially as shown in FIG. 10. If a tightener is used, only one is needed. The tightener is attached to the first and second tightener connections. Keeping tension on the first and second fiberglass straps the holding means is removed and the tightener is ratcheted until a second hole on the slider section is aligned with a second hole on the slot section. The slider section and slot section are then pinned together by passing the holding means through the aligned holes. As before, the ratcheting and pinning steps are repeated until the first and second fiberglass straps are snug but not overtight. The entire process is repeated for each of the ribs on the tank.

The preferred embodiments of the split strap take-up assemblies described are best suited for underground tanks between 1.83 meters and 3.05 meters in diameter. However, the present invention may be subject to many modifications and changes without departing from the spirit or essential characteristics thereof. The present embodiments are therefor to be considered in all respects as illustrative and not restrictive of the scope of the invention as defined by the appended claims.

We claim:

1. A split strap take-up assembly comprising:

an elongated slider section;

a first slot section in slidable relation to said slider section and having a J-shaped groove in a top edge, said J-shaped groove extending from a first side surface of the slot section to a second side surface of the slot section and opening towards a first side edge of the slot section;

a second slot section in slidable relation to said slider section and having a J-shaped groove in a top edge, said J-shaped groove extending from a first side surface to a second side surface and opening towards a first side edge;

at least one tightener connection attached to a top edge of said slider section;

at least one tightener connection attached to the top edge of said first slot section between the J-shaped groove of the slot section and forward of the J-shaped groove;

at least one tightener connection attached to the top edge of said second slot section and forward of the J-shaped groove;

a first slider foot pivotally connected to said first slot section near an end of said first slot section;

a second slider foot pivotally connected to said second slot section near an end of said second slot section;

a first holding means removably affixed to said first slot section and said slider section; and a second holding means removably affixed to said second slot section and said slider section.

2. The split strap take-up assembly of claim 1 wherein said elongated slider section has an inverse T-shaped cross-section when viewed through a transverse plane and a plurality of holes in a substantially V-shaped pattern through an upright of the inverse T-shape, wherein the V-shape has an apex near the top edge of and at a transverse axis of said slider section, a first leg of the V-shape extending towards a bottom plate and a first side edge at an angle between 60° and 80° from the transverse axis, and a second leg of the V-shape extending towards the bottom plate and a second side edge at an angle between 60° and 80° from the transverse axis.

3. The split strap take-up assembly of claim 2 wherein said first slot section is a substantially rectangular shaped 0.318 cm to 1.9 cm thick plate with a plurality of holes equally spaced along a longitudinal axis, said holes extending from the first side surface to the second side surface, wherein the plurality of holes are substantially similar in size to the plurality of holes in said elongated slider section; and said second slot section is a substantially rectangular shaped 0.318 cm to 1.9 cm thick plate with a plurality of holes equally spaced along a longitudinal axis, said holes extending from the first side surface to the second side surface, wherein the plurality of holes are substantially similar in size to the plurality of holes in said elongated slider section.

4. The split strap take-up assembly of claim 3 wherein said first slot section has a pivot hole extending from the first side surface to the second side surface and positioned beneath the J-shaped groove;

said second slot section has a pivot hole extending from the first side surface to the second side surface and positioned beneath the J-shaped groove;

said first slider foot further comprises a bottom plate, a first side plate substantially perpendicular to and attached to said bottom plate and having a hole substantially parallel to said bottom plate, wherein said hole is similar in size to the pivot hole in said first slot section, and a second side plate attached to said bottom plate and substantially parallel to and spaced apart from said first side plate and having a hole substantially parallel to said bottom plate, wherein said hole is similar in size to and concentric with the hole of said first side plate, wherein said first slot section is pivotally received between the first and second side plates of said first slider foot;

said second slider foot further comprises a bottom plate, a first side plate substantially perpendicular to and attached to said bottom plate and having a hole substantially parallel to said bottom plate, wherein said hole is similar in size to the pivot hole in said second slot section, and a second side plate attached to said bottom plate and substantially parallel to and spaced apart from said first side plate and having a hole substantially parallel to said bottom plate, wherein said hole is similar in size to and concentric with the hole of said first side plate, wherein said second slot section is pivotally received between the first and second side plates of said second slider foot; and further comprising a first pivot means passing through the pivot hole of said first slot section and the holes of said first slider foot; and a second pivot means passing through the pivot hole of said second slot section and the holes of said second slider foot.

5. The split strap take-up assembly of claim 4 further comprising a first rubber pad mounted to a bottom surface of the bottom plate of said elongated slider section.

6. The split strap take-up assembly of claim 5 further comprising:

a second rubber pad mounted to a bottom surface of the bottom plate of said first slider foot; and a third rubber pad mounted to a bottom surface of the bottom plate of said second slider foot.

7. The split strap take-up assembly of claim 6 wherein the plurality of holes in said elongated slider section each have a center, the centers of the holes are spaced between 2.85 cm and 3.49 cm apart, and each hole has a diameter sized to receive a holding means about 1.75 cm in diameter;

the plurality of holes in said first and second slot sections each have a center, the centers of the holes are spaced between 3.49 cm and 4.13 cm apart, and each hole has a diameter to receive a holding means about 1.75 cm in diameter;

the J-shaped grooves in said first and second slot sections each have an opening along the top edge of between 2.85 cm and 3.49 cm, a first long side and a second short side substantially parallel to said first long side and spaced between 1.9 cm and 2.54 cm from said first long side, wherein said sides of said J-shaped grooves are between 75° and 77° from a second side edge of said first and second slot sections, said second short sides being uppermost towards the top edges of said first and second slot sections, and wherein an apex of each said J-shape is between 4.45 cm and 5.72 cm from the second edges and between 3.49 cm and 4.76 cm from a bottom edge of said first and second slot sections; and each tightener connection has an U-shaped groove in a top edge, said U-shaped groove having a width between 1.58 cm and 2.22 cm and an apex of the groove between 1.58 cm and 2.22 cm from a top edge.

8. A split strap take-up assembly comprising:

a slider section having a J-shaped groove in a top edge, said J-shaped groove extending from a first side surface to a second side surface and opening towards a first side edge;

a slot section in slidable relation to said slider section comprising a first leg and a second leg parallel to and spaced apart from said first leg;

a strap hook section having a J-shaped groove in a top edge, said J-shaped groove extending from a first side surface to a second side surface and opening towards a first side edge, wherein said first side edge of said strap hook section is attached to said slot section;

a bottom plate having a top surface attached to a bottom edge of said first leg, a bottom edge of said second leg, and a bottom edge of said strap hook section;

a first tightener connection attached to said slider section;

a second tightener connection attached to said slot section;

a slider foot connected to said slider section; and a holding means removably affixed to said slider section and said slot section.

9. The split strap take-up assembly of claim 8 wherein said slider section is a substantially arc-shaped 0.32 cm to 0.95 cm thick by 6.35 cm to 7.62 wide plate defined at the top edge by an angle of about 28.6° at a radius of about 64.77 cm, said slider section having a plurality of holes extending from the first side surface to the second side surface along a central arc, wherein each hole has a center, the centers of the holes are spaced between 2.85 cm and 3.49 cm apart, and each hole has a diameter sized to receive a holding means about 1.75 cm in diameter;

said first and second legs of said slot section are substantially arc-shaped 0.31 cm to 0.64 cm thick plates defined at a top edge by an angle of about 26.0° at a radius of about 58.42 cm, wherein said first and second legs have a height about 0.63 cm less than the width of said slider section, and wherein said first and second legs each have a plurality of holes which follow a central arc located, each hole has a center, the centers of the holes are spaced between 3.49 cm and 4.13 cm apart, each hole has a diameter sized to receive a holding means about 1.75 cm in diameter, and the centermost holes are located about 12.2° at a radius of about 31.0 cm away from a side edge of each said first and second leg;

said strap hook section is a substantially arc-shaped 0.32 cm to 0.95 cm thick plate;

said bottom plate is a substantially arc-shaped 0.15 cm to 0.48 cm thick plate defined by an angle of about 31.1° at a radius of about 66.36 cm; and said slider foot is formed from 0.15 cm to 0.48 cm thick plate material.

10. The split strap take-up assembly of claim 9 wherein the J-shaped grooves in said slider section and said strap hook section each have an opening along the top edge of between 2.85 cm and 3.49 cm, a first long side and a second short side substantially parallel to said first short side and spaced between 1.9 cm and 2.54 cm from said first long side, wherein said sides of said J-shaped grooves are between 75° and 77° from a second side edge of each said slider section and said strap hook section, said second short sides being uppermost towards said top edges of said slider section and strap hook section, and wherein an apex of each said J-shape is between 4.45 cm and 5.72 cm from the second edges and between 3.49 cm and 4.76 cm from a bottom edge of each said slider section and strap hook section;

said first tightener connection has a U-shaped groove in a top edge; and said second tightener connection has a U-shaped groove in a top edge and is attached to the top edge of the first leg and the top edge of the second leg of said slot section;

wherein the U-shaped groove of each tightener connection is between 1.58 cm and 2.22 cm in diameter with an apex of the groove between 1.58 cm and 2.22 cm from the top edge.

11. The split strap take-up assembly of claim 10 further comprising a first rubber pad mounted to a bottom surface of said bottom plate; and a second rubber pad mounted to a bottom surface of said slider foot.

12. A method for anchoring an underground fiberglass storage tank without the need for shoring or hole stabilization comprising:

installing an underground fiberglass storage tank having a plurality of anchor ribs;

installing a first plurality of deadmen or anchor pads on one side of the tank wherein each first deadman or anchor pad is in alignment with an anchor rib;

installing a second plurality of deadmen or anchor pads on an other circumferentially opposite side of the tank wherein each second deadman or anchor pad is in alignment with an anchor rib;

attaching a first fiberglass strap having a hook end and an eye end to a first deadman or anchor pad, wherein the hook end is attached to the deadman or anchor pad;

attaching a second fiberglass strap having a hook end and an eye end to a second deadman or anchor pad in opposite association with the same rib as said first deadman or anchor pad, wherein the hook end is attached to the deadman or anchor pad;

placing a split strap take-up assembly on the rib in association with said first and second fiberglass straps, wherein the split strap take-up assembly comprises an elongated slider section, a first slot section in slidable relation to said slider section and having a J-shaped groove in a top edge, said J-shaped groove extending from a first side surface to a second side surface and opening towards a first side edge, a second slot section in slidable relation to said slider section and having a J-shaped groove in a top edge, said J-shaped groove extending from a first side surface to a second side surface and opening towards a first side edge, at least one tightener connection attached to a top edge of said slider section, at least one tightener connection attached to the top edge of said first slot section and forward of the J-shaped groove, at least one tightener connection attached to the top edge of said second slot section and forward of the J-shape groove, a first slider foot pivotally connected to said first slot section, a second slider foot pivotally connected to said second slot section, a first holding means removably affixed to said first slot section and said slider section, a second holding means removably affixed to said second slot section and said slider section, and a first rubber pad adjacent to a bottom surface of said slider section;

placing the eye end of said first fiberglass strap in the J-shaped groove of said first strap hook section;

placing the eye of said second fiberglass strap in the J-shaped groove of said second strap hook section;

keeping tension on said first and second fiberglass straps;

attaching a first tightener to one tightener connection on said slider section and a tightener connection on said first slot section;

attaching a second tightener to a second tightener connection on said slider section and to a tightener connection on said second slot section;

removing said first holding means;

ratcheting said take-up assembly until a second hole on said slider section is aligned with a second hole on said first slot section;

pinning said slider section and said first slot section together by passing said first holding means through the aligned holes;

removing said second holding means;

ratcheting said take-up assembly until a third hole on said slider section is aligned with a second hole on said second slot section;

pinning said slider section and said second slot section together by passing said second holding means through the aligned holes;

repeating ratcheting and pinning until said first and second fiberglass straps are snug;

repeating said method for each of the ribs on said tank.

13. The method of claim 12 wherein said elongated slider section has an inverse T-shaped cross-section when viewed through a transverse plane and a plurality of holes in a substantially V-shaped pattern, wherein the V-shape has an apex near a top edge of and at a transverse axis of said slider section, a first leg extending towards a bottom surface and a first side edge at an angle between 60° and 80° from the transverse axis, and a second leg extending towards the bottom surface and a second side edge at an angle between 60° and 80° from the transverse axis, and wherein the holes each have a center, the centers of the holes are spaced between 2.85 cm and 3.49 cm apart, and each hole has a diameter sized to receive a holding means about 1.75 cm in diameter;

said first slot section is a substantially rectangular shaped 0.318 cm to 1.9 cm thick plate having a pivot hole positioned beneath the J-groove and extending from a first side surface to a second side surface, and a plurality of holes equally spaced along a longitudinal axis, said holes extending from a first side surface to a second side surface, wherein the plurality of holes each have a center, the centers of the holes are spaced between 3.49 cm and 4.13 cm apart, and the plurality of holes are substantially similar in size to the plurality of holes in said elongated slider section;

said second slot section is a substantially rectangular shaped 0.318 cm to 1.9 cm thick plate having a pivot hole positioned beneath the J-groove and extending from a first side surface to a second side surface, and a plurality of holes equally spaced along a longitudinal axis, said holes extending from a first side surface to a second side surface, wherein the plurality of holes each have a center, the centers of the holes are spaced between 3.49 cm and 4.13 cm apart, and the plurality of holes are substantially similar in size to the plurality of holes in said elongated slider section;

the J-shaped grooves in said first and second slot sections each have an opening along the top edge of between 2.85 cm and 3.49 cm, a first long side and a second short side substantially parallel to said first short side and spaced between 1.9 cm and 2.54 cm from said first long side, wherein said sides of said J-shaped grooves are between 75° and 77° from the second side edges of said first and second slot sections, said second short sides being uppermost towards said top edges of said first and second slot sections, and wherein an apex of each said J-shape is between 4.45 cm and 5.72 cm from the second edges and between 3.49 cm and 4.76 cm from the bottom edges of said first and second slot sections;

said first slider foot further comprises a bottom plate, a first side plate substantially perpendicular to said bottom plate and having a bottom edge attached to a top surface of said bottom plate and a hole extending from a first side surface to a second side surface, wherein said hole is similar in size to the pivot hole in said first slot section, and a second side plate substantially parallel to and spaced apart from said first side plate and having a bottom edge attached to the top surface of said bottom plate and a hole extending from a first side surface to a second side surface, wherein said hole is similar in size to and concentric with the hole of said first side plate, wherein said first slot section is pivotally received between the first and second side plates of said first slider foot;

said second slider foot further comprises a bottom plate, a first side plate substantially perpendicular to said bottom plate and having a bottom edge attached to a top surface of said bottom plate and a hole extending from a first side surface to a second side surface, wherein said hole is similar in size to the pivot hole in said second slot section, and a second side plate substantially parallel to and spaced apart from said first side plate and having a bottom edge attached to the top surface of said bottom plate and a hole extending from a first side surface to a second side surface, wherein said hole is similar in size to and concentric with the hole of said first side plate, wherein said second slot section is pivotally received between the first and second side plates of said second slider foot; and each tightener connection has an U-shaped groove between 1.58 cm and 2.22 cm in diameter with an apex of the groove between 1.58 cm and 2.22 cm from a top edge; and further comprising a first pivot means passing through the pivot hole of said first slot section and the holes of said first slider foot; and a second pivot means passing through the pivot hole of said second slot section and the holes of said second slider foot.

14. The method of claim 13 wherein the underground tank is between 1.83 meters and 3.05 meters in diameter.

15. A method for anchoring an underground fiberglass storage tank without the need for shoring or hole stabilization comprising:

installing an underground fiberglass storage tank having a plurality of anchor ribs;

installing a first plurality of deadmen or anchor pads on one side of the tank wherein each first deadman or anchor pad is in alignment with an anchor rib;

installing a second plurality of deadmen or anchor pads on an other circumferentially opposite side of the tank wherein each second deadman or anchor pad is in alignment with an anchor rib;

attaching a first fiberglass strap having a hook end and an eye end to a first deadman or anchor pad, wherein the hook end is attached to the deadman or anchor pad;

attaching a second fiberglass strap having a hook end and an eye end to a second deadman or anchor pad in association with the same rib as said first deadman or anchor pad, wherein the hook end is attached to the deadman or anchor pad;

placing a split strap take-up assembly on the rib in association with said first and second fiberglass straps, wherein the split strap take-up assembly comprises a slider section having a J-shaped groove in a top edge, said J-shaped groove extending from a first side surface to a second side surface and opening towards a first side edge, a slot section in slidable relation to said slider section comprising a first leg and a second leg parallel to and spaced apart from said first leg, a strap hook section attached to said slot section and having a J-shaped groove in a top edge, said J-shaped groove extending from a first side surface to a second side surface and opening towards a first side edge, a bottom plate having a top surface attached to a bottom edge of said first leg, a bottom edge of said second leg, and a bottom edge of said strap hook section, a first tightener connection attached to the top edge of said slider section, a second tightener connection attached to a top edge of said slot section and forward of said strap hook section, a slider foot connected to a bottom edge of said slider section, a holding means removably affixed to said slider section and said slot section, a first rubber pad adjacent to a bottom surface of said bottom plate, and a second rubber pad adjacent to a bottom surface of said slider foot;

placing the eye end of said first fiberglass strap in the J-shaped groove of said first strap hook section;

placing the eye of said second fiberglass strap in the J-shaped groove of said second strap hook section;

keeping tension of said first and second fiberglass straps;

attaching a tightener to the first tightener connection and to the second tightener connection;

removing said holding means;

ratcheting said take-up assembly until a second hole on said slider section is aligned with a section hole on said slot section;

pinning said slider section and said slot section together by passing said holding means through the aligned holes;

repeating ratcheting and pinning until said first and second fiberglass straps are snug;

repeating the method for each of the ribs on said tank.

16. The method of 15 wherein said slider section is a substantially arc-shaped 0.32 cm to 0.95 cm thick by 6.35 cm to 7.62 wide plate defined at the top edge by an angle of about 28.6° at a radius of about 64.77 cm, said slider section having a plurality of holes extending from the first side surface to the second side surface along a central arc located between 2.8 cm to 2.9 cm above the bottom edge, wherein each hole has a center, the centers of the holes are spaced between 2.85 cm and 3.49 cm apart, and each hole has a diameter sized to receive a holding means about 1.75 cm in diameter;

said first and second legs of said slot section are substantially arc-shaped 0.31 cm to 0.64 cm thick plates defined at a top edge by an angle of about 26.0° at a radius of about 58.42 cm, wherein said first and second legs have a height about 0.63 cm less than the width of said slider section, and wherein said first and second legs each have a plurality of holes which follow a central arc located between 2.8 cm to 2.9 cm above a bottom edge, each hole has a center, the centers of the holes are spaced between 3.49 cm and 4.13 cm apart, each hole has a diameter sized to receive a holding means about 1.75 cm in diameter, and the centermost holes are located about 12.2° at a radius of about 31.0 cm away from a side edge of each said first and second leg;

said strap hook section is a substantially arc-shaped 0.32 cm to 0.95 cm thick plate;

said bottom plate is a substantially arc-shaped 0.15 cm to 0.48 cm thick plate defined at the top surface by an angle of about 31.1° at a radius of about 66.36 cm;

said slider foot is formed from 0.15 cm to 0.48 cm thick plate material;

the J-shaped grooves in said slider section and said strap hook section each have an opening along the top edge of between 2.85 cm and 3.49 cm, a first long side and a second short side substantially parallel to said first short side and spaced between 1.9 cm and 2.54 cm from said first long side, wherein said sides of said J-shaped grooves are between 75° and 77° from a second side edge of each said slider section and said strap hook section, said second short sides being uppermost towards said top edges of said slider section and strap hook section, and wherein an apex of each said J-shape is between 4.45 cm and 5.72 cm from the second edges and between 3.49 cm and 4.76 cm from the bottom edges of each said slider section and strap hook section;

said first tightener connection has a U-shaped groove in a top edge; and said second tightener connection has a U-shaped groove in a top edge and is attached to the top edge of the first leg and the top edge of the second leg of said slot section;

wherein the U-shaped groove of each tightener connection is between 1.58 cm and 2.22 cm in diameter with an apex of the groove between 1.58 cm and 2.22 cm from the top edge.

17. The method of claim 16 wherein the underground tank is between 1.83 meters and 3.05 meters in diameter.

18. An assembly for taking up a strap comprising a buckle member having a first end and a second end, said buckle member having a first means for attachment to a strap at the first end and a second means for attachment to a strap at the second end;

wherein the buckle member comprises a base plate, and an upright plate, said upright plate having a first side surface and a second side surface, said upright plate being connected substantially perpendicularly to the base plate to form an elongated buckle member having an inverse T-shaped cross-section;

said upright plate defining a plurality of pin-receiving boreholes extending therethrough longitudinally spaced apart from the first side surface to the second side surface from a position adjacent to the first end of the buckle member;

wherein the first means for attachment to a strap comprises an elongated plate member having a first end, a second end, a first side surface, and a second side surface, said elongated plate member having a means for attachment to a strap located near the second end, and a plurality of longitudinally spaced apart pin-receiving boreholes extending therethrough from a position adjacent to the first end of the elongated plate member;

wherein the boreholes in the elongated plate member have a first spacing relationship and the boreholes in the upright plate have a second spacing relationship so that the boreholes in the elongated plate member have a vernier relationship with the boreholes in the upright plate, permitting a borehole in the upright plate to come into alignment with a borehole in the elongated plate member as the first side surface of the elongated plate member is slid past the first side surface of the upright member at an adjustment increment which is less than the spacing between either the boreholes through the upright member or the boreholes through the elongated member; and a pin sized to be closely received by the boreholes.

19. An assembly as in claim 18 wherein the pin has a first end and a second end, wherein a head is positioned at the first end and a tapering surface is positioned adjacent to the second end.

20. A method for tightening a strap, said method comprising:

providing a first strap end and a second strap end and a connecting means between the first strap end and the second strap end;

affixing a first elongated plate member to the first strap end and a second elongated plate member to the second strap end, each of said first elongated plate member and said second elongated plate member having a first surface and a second surface and a plurality of longitudinally spaced apart boreholes extending therethrough from the first side surface to the second side surface, wherein the boreholes in the first elongated plate member have a first spacing relationship and the boreholes in the second elongated plate member have a second spacing relationship so that the boreholes in the first elongated plate member have a vernier relationship with the boreholes in the second elongated plate member, permitting a borehole in the first elongated plate member come into alignment with a borehole in the second elongated plate member as the first side surface of the first elongated plate member is slid past the first side surface of the second elongated plate member at an adjustment increment which is less than the spacing between either the boreholes through the first elongated plate member or the boreholes through the second elongated member;

sliding the first side of the first plate member past the first side of the second plate member until the strap is tightened and a borehole in the first elongated plate member is aligned with a borehole in the second elongated plate member; and positioning a pin in the aligned holes of the first elongated plate member and the second elongated plate member to hold the strap in the tightened position.

* * * * *